US005385108A

United States Patent [19]

Thompson

[11] Patent Number: 5,385,108

[45] Date of Patent: Jan. 31, 1995

[54] AUTOMATIC TRANSOM SCUPPER VALVE

[76] Inventor: David M. Thompson, 802 Mantoloking Rd., Brick Town, N.J. 08723

[21] Appl. No.: 177,520

[22] Filed: Jan. 4, 1994

[51] Int. Cl.[6] ..... B63B 13/00

[52] U.S. Cl. ..... 114/183 R; 114/197

[58] Field of Search ..... 114/183 R:184, 185, 114/182, 197

[56] References Cited

U.S. PATENT DOCUMENTS

| | | | |
|---|---|---|---|
| 63,496 | 4/1867 | Fox | 114/185 |
| 1,800,556 | 4/1931 | Mead | 114/182 |
| 2,655,121 | 10/1953 | Cuneo | 114/183 R |
| 2,713,841 | 7/1955 | Forbes | 114/183 R X |
| 3,459,150 | 8/1969 | Lunde, Jr. | 114/183 R |

*Primary Examiner*—Sherman Basinger

*Attorney, Agent, or Firm*—Charles F. Gunderson

[57] ABSTRACT

An automatic valve is attached to the lower edge of the transom of a boat. The valve is a short tubular device that is aligned with a hole in the transom and mounted on the transom in a substantially horizontal plane, in a watertight manner. The inner end of the device may follow the slope of the transom. However, a cap, hinged at its top, covers and seals the outer end of the device, and the bottom of the outer end projects out beyond the top to provide enough slope for the cap to be held by gravity against the outer end. This closes the valve against water pressure from the outside, but allows bilge water to flow out when there is no external pressure. The valve may be, normally, under water, but can drain the bilge when the hull is out of water, or moving quickly enough through the water to clear the transom.

2 Claims, 1 Drawing Sheet

AUTOMATIC TRANSOM SCUPPER VALVE

BACKGROUND OF THE INVENTION

A transom scupper drain is almost a necessity for most boats today. This is centered around a device that seals an opening in the bottom of the transom, usually below the actual waterline. This must have a lid on the outside that is normally closed to prevent the entrance of seawater, but that can open, or be opened, to allow the bilge water, from leakage, rain, or spray, to be drained when the boat is on land, or in use at a speed through the water that is enough to clear the transom.

In most situations, it should be self-opening when the pressure of the water on the inside, from the bilge, is greater than the pressure of the water on the outside. This, again, happens when the boat is out of water, or moving through the water fast enough to clear the transom.

There are very many devices—too many to be listed here—that can be used in combination with a hole in the bottom of the transom, with a valve of some kind, that can be opened to let the water drain out. There are many variations of this with varying degrees of simplicity and effectiveness. Some are manually controlled, but for the type considered here, again, the stopper or lid should function automatically to seal itself against water trying to come in from the outside, but open itself to allow water to flow out of the hull when the pressure from the inside is greater than the pressure from the outside.

For this type of scupper drain valve, a lid must cover the opening, and must be held in place to prevent sea water from pouring into the bilge. The most common versions have a spring of some kind urging the lid or cap against the base of the device that covers the opening in the bottom of the transom. Under ideal conditions, when the spring is new, this spring device can function quite well, but with age and wear, and deterioration of the metal of the spring, the lid may not open in a timely manner, or adequately, to allow the bilge to drain out, or may not close properly to keep the sea water from coming back in.

Metallic springs are, inevitably, subject to corrosion, and mechanical deterioration—particularly when in contact with sea water. Plastic springs, on the other hand, deteriorate when exposed to heat and sunlight, as well as from ageing, and in other ways.

The object of this invention is to provide a lid closure that has a consistant, very-light pressure that is just enough to hold the lid closed when there is no other pressure on the lid, yet openable at minimal pressure from the inside to let the bilge water out. Sea water from the outside will meet a closed lid, and the pressure from the outside will seal the lid more tightly.

The very-light pressure on the closure should be consistent at all times, and should not vary from season to season, or over a considerable length of time. The mechanism should be easy to maintain, repair, or replace.

This is accomplished here by a gravity-controlled, hinged lid that rests on and covers a tubular opening that may be sloped well away from the vertical. The tubular opening and hinged lid are part of a unit that can be mounted in a watertight manner over a hole in the transom of a boat below the level of the bilge. Since this is controlled by gravity, rather than a spring, it will function consistently and uniformly from season to season, year in and year out, almost indefinitely.

SUMMARY OF THE INVENTION

A hole in the transom of a boat below the level of the bilge is covered by a device that is attached to the transom in a watertight manner. It includes a tubular portion that aligns with or fits into the hole in the transom, and is mounted through the transom in a substantially horizontal manner. The inner side of the device and tubular portion should be flush with and secured to the transom in a watertight manner. The outer side of the tubular portion of the device may be sloped outwardly, away from the vertical, and supports a lid that is hinged at the top of the tubular portion to rest on the sloped, surface of the outer side of the tubular portion. The slope of the outer side of the tubular portion is far enough away from vertical that the weight of the lid, and gravity, holds the lid against the outer opening of the tubular portion when there is no internal water pressure applied. The outer surface of the tubular portion and the inner surface of the lid are machined or molded to provide a watertight junction.

DETAILED DESCRIPTION OF THE DRAWINGS

Figure 1:
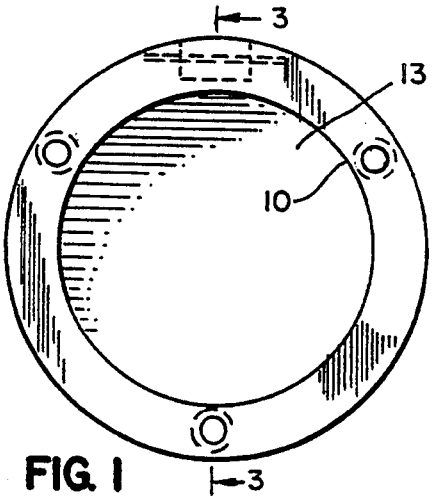
FIG. 1 shows a rear view of the device.

Referring now more particularly to FIG. 1, a rear view of the basic device is shown with a tubular body portion 10 and a cap or lid portion 13.

Figure 2A:
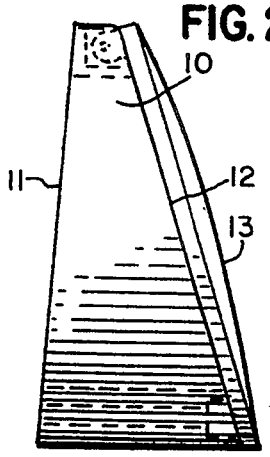
FIG. 2A shows a side view of the device closed.

FIG. 2A shows a side view of the device of FIG. 1 with the lid 13 resting on the outer surface 12 of the body 10, in a closed condition. The inner surface 11 will be secured to a transom, not shown.

Figure 2B:
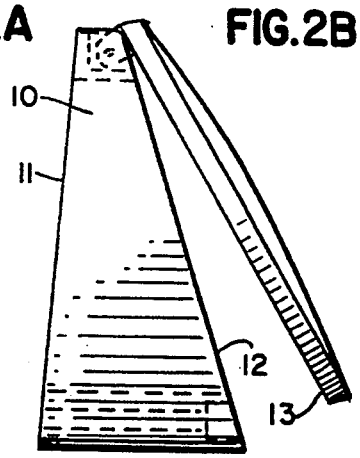
FIG. 2B shows a side view of the device open.

FIG. 2B shows another side view of the device of FIG. 1, with similar elements similarly numbered, in an open condition. The angle of opening will vary with the pressure of any water on the inside, and the flow of water coming out.

Figure 3A:
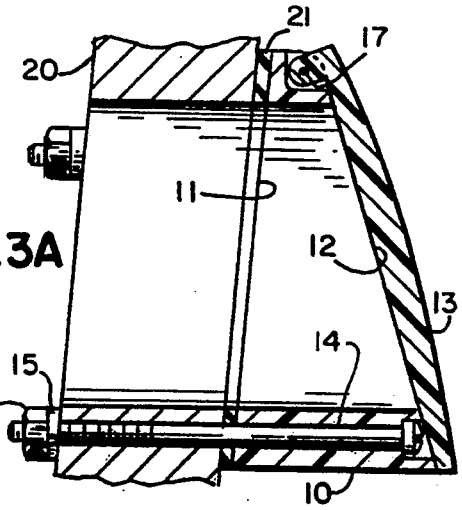
FIG. 3A shows a cross section of the device, along the lines 3—3 of FIG. 1, attached to a transom, closed.

FIG. 3A shows a cross section of the device of FIG. 1, along the lines 3—3 of FIG. 1, attached to a transom 20. In this case, the body portion 10 is held against the transom 20 by means of bolts, such as 14, which may be secured by nuts, such as 16, against washers, such as 15. A gasket 21 separates the device from the transom and seals the juncture. A pivot 17 supports and hinges the cap 13.

Figure 3B:
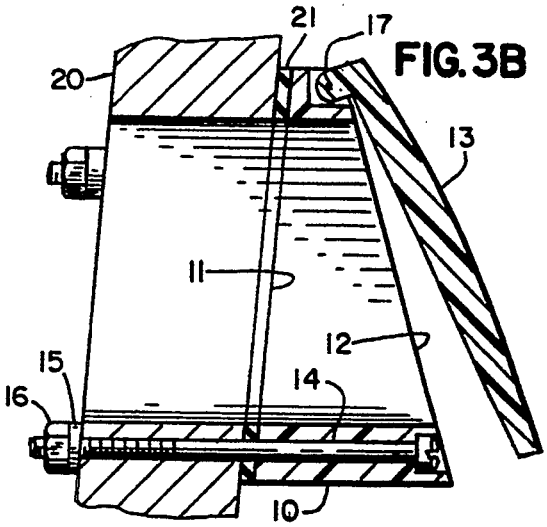
FIG. 3B shows a cross section of the device, along the lines 3—3 of FIG. 1, attached to a transom, open.

FIG. 3B shows the same device as in FIG. 3A, with similar elements similarly numbered. Here the hinged lid 13 is again in an open position for the release of bilge water.

It is obvious in both of the FIGS. 3, and in all of these devices, that the outer surface 12 of the tubular portion of the body 10, on which the cap 13 rests to form a watertight seal, is sloped at a substantial angle outward—away from the vertical—so that gravity and the weight of the lid provide the force to hold the cap against the outer body portion.

It should be noted here that weight of the cap, and even a configuration of the cap to put its weight further out from the pivot 17 would reduce the angle that would be needed for the outward slope angle. In all of these devices, it is only necessary to have the cap resting lightly—but securely—on the outer slope so that the sea water coming up against the outer cap or lid of the device will meet a closed valve on which it will apply its own additional closing pressure.

Figure 4:
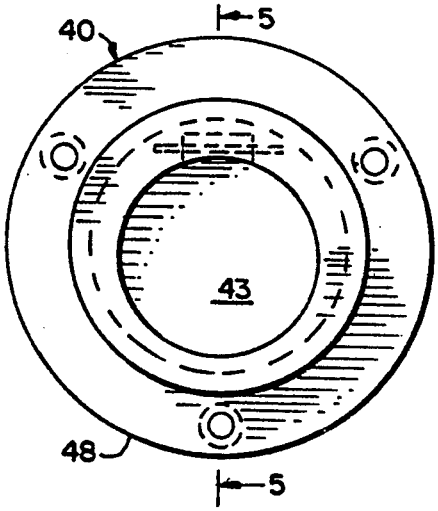
FIG. 4 shows a rear view of a similar device.

FIG. 4 is a rear view of a variation of the basic device. Here flanges 48 are formed as a part of the basic body 40, and the lid, or cap, 43 is hinged, to the top of the body as before, as will be seen in more detail in the cross sections of FIGS. 5 and 6.

Figure 5:
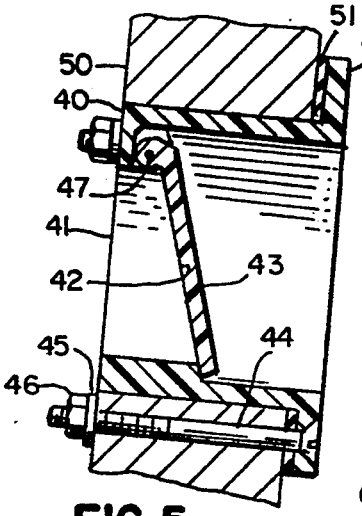
FIG. 5 shows a cross section of the device, along the lines 5—5 of FIG. 4, attached to a transom, closed.

FIG. 5 shows a cross section of the device, along the lines 5—5 of FIG. 4. Here the body 40 fits within a transom 50, and the inner surface 41, of the body may be flush with the inner surface of the transom. The tubular portion 40 of the device projects with its sloping outer side 42, as well as the lid 43, are within the body of the transom 50. The body, here, now includes the flange 48, that is seated on a gasket 51, and is secured to the transom by means of bolts, such as 44; washers, such as 45; and nuts, such as 46. The inner surface 41 of the tubular portion 40 may be flush with the inside of the transom.

Figure 6:
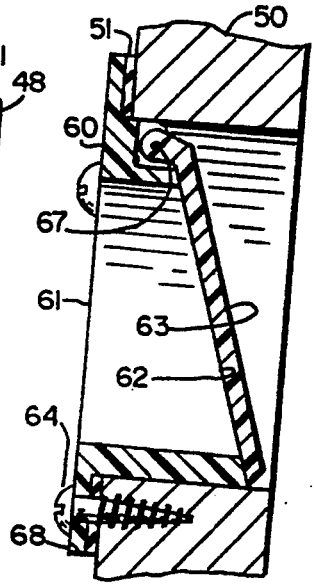
FIG. 6 shows a cross section of a variation of the device of FIGS. 1 and 4, attached to a transom, closed.

FIG. 6 shows a cross section of another variation that resembles both of the earlier species. Here a flange 68 is, again, part of the inner portion of the body 60, and is used to secure the device, which otherwise resembles that of FIG. 3B, to the transom. Here, with a slightly enlarged hole in the transom, the flange can be secured to the inside of the transom, and the body and cap can be contained and function more or less within the transom. Here the inner surface 61 of the device is parallel with the inner surface of the transom, and the outer surface 62 is within the transom to support the cap 63.

The flange 68, actually, could also be fastened to the outside of the transom, as in the device of 3B. This would appear much the same as the device of FIG. 3B, and might be simpler to mount and to seal, but this would lose the protection of the transom for the cap.

The purpose and value of mounting the cap within the transom, is to avoid the danger of the cap or its hinge being physically damaged by anything floating in the water, or any physical activity, such as swimming or water skiing, around the transom. The hinge, actually, must be rather delicate to function solely by the force of gravity, and would be quite vulnerable to physical damage. Here, as in FIGS. 5 and 6, the cap and hinge can be completely enclosed and protected.

On the other hand, a tubular sleeve could be molded around the device or added to the device to extend past the cap to protect the cap of any of the species of this device, whether it is mounted either inside or outside of the transom. For example, the device of FIG. 5 could have its flange 48 molded or attached to the inside of the body 60, instead of the outside, as shown. The device could then be fastened and gasketed on the inside and still be located in the position within the transom, as shown, with the same advantages.

On the other hand, it could also be mounted and gasketed on the outside of the transom, as with the device of FIG. 3, but with the tubular body portion protecting the cap.

As an additional advantage of the mounting inside the transom, a seal or plug, not shown, could be lowered and applied to the outside of the hole in the transom, and the device can be removed from the inside for repair or replacement, while the boat is still in the water. This would not be possible with an externally mounted transom scupper valve of any type.

While only 3 fasteners, such as 14 in FIGS. 3, are shown, for simplicity, is is obvious that more fasteners—and any other types of fasteners—could be used to secure the valve to a transom.

The basic device could be made of any type of material, from metals to plastics. However, it is essential that the hinge, while being strong enough to support the cap, must function smoothly and freely with only the weight of the cap and gravity to actuate it. The cap must rest lightly, but tightly against the outer surface, such as 12 of the tubular body portion 10, yet open easily when water is to flow out. The hinge must operate uniformly and consistently under all weather conditions and over a long period of time.

I claim:

1. A transom drain for the bilge of a power boat comprising: a hollow tubular section having an inner end and an outer end; a transom having a hole through its bottom at the level of said bilge, said hole being large enough and said transom being thick enough to accommodate said hollow tubular section; means for securing said hollow tubular section within said transom, in a watertight manner, in line with said hole in said transom, with said tubular section in a substantially horizontal position, to provide an outlet for bilge water; means for sealing said hollow tubular section against sea water entering said bilge comprising a cap of a size and shape to cover and seal said outer end of said hollow tubular section; means for hinging the top of said cap to the top of said outer end, said outer end being sloped, and said cap having enough weight outside of said means for hinging to be held against said outer end by the force of gravity; whereby said gravity-seated cap will hold out sea water but can open to drain bilge water when the sea water recedes from said transom with minimal exposure to external damage inside or outside of said transom.

2. A transom drain, as in claim 1, having a round sleeve enclosing said hollow tubular section, in a watertight manner, extending beyond said cap, to protect said cap in operation; said means for securing said hollow tubular section to said transom comprises a flange, extending around said round sleeve, to be secured to said transom, in a watertight manner, around said hole in said transom.

* * * * *